US007737354B2

(12) United States Patent
Basu et al.

(10) Patent No.: US 7,737,354 B2
(45) Date of Patent: Jun. 15, 2010

(54) CREATING MUSIC VIA CONCATENATIVE SYNTHESIS

(75) Inventors: Sumit Basu, Seattle, WA (US); Ian Simon, Seattle, WA (US); David Salesin, Seattle, WA (US); Maneesh Agrawala, Berkeley, CA (US); Adil Sherwani, Seattle, WA (US); Chad Gibson, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 11/424,492

(22) Filed: Jun. 15, 2006

(65) Prior Publication Data

US 2007/0289432 A1 Dec. 20, 2007

(51) Int. Cl.
*G10H 7/00* (2006.01)
*G10H 1/18* (2006.01)

(52) U.S. Cl. ..... 84/618; 84/609; 84/645

(58) Field of Classification Search ..... 84/603, 84/604, 605, 606, 607, 608, 609, 610, 645, 84/618

See application file for complete search history.

(56) References Cited

U.S. PATENT DOCUMENTS

| | | | |
|---|---|---|---|
| 4,527,274 | A | 7/1985 | Gaynor |
| 4,613,985 | A | 9/1986 | Hashimoto |
| 5,703,311 | A | 12/1997 | Ohta |
| 5,750,912 | A | 5/1998 | Matsumoto |
| 5,895,449 | A | 4/1999 | Nakajima |
| 6,304,846 | B1 | 10/2001 | George |
| 6,424,944 | B1 | 7/2002 | Hikawa |
| 6,576,828 | B2 | 6/2003 | Aoki |
| 7,015,389 | B2 | 3/2006 | Georges |
| 7,016,841 | B2 | 3/2006 | Kenmochi |
| 2004/0019485 | A1 | 1/2004 | Kobayashi |
| 2004/0243413 | A1 | 12/2004 | Kobayashi |
| 2005/0137880 | A1 | 6/2005 | Bellwood |

OTHER PUBLICATIONS

Ian Simon, Sumit Basu, David Salesin, and Maneesh Agrawala. "Audio Analogies: Creating New Music from an Existing Performance by Concatenative Synthesis." In Proceedings of the Int'l Conf. on Comp. Music 2005. Aug. 2005.*

(Continued)

*Primary Examiner*—Jeffrey Donels
*Assistant Examiner*—Andrew R Millikin
(74) *Attorney, Agent, or Firm*—Lyon & Harr, LLP; Mark A. Watson

(57) ABSTRACT

A "Concatenative Synthesizer" applies concatenative synthesis to create a musical output from a database of musical notes and an input musical score (such as a MIDI score or other computer readable musical score format). In various embodiments, the musical output is either a music score, or an analog or digital audio file. This musical output is constructed by evaluating the database of musical notes to identify sets of candidate notes for each note of the input musical score. An "optimal path" through candidate notes is identified by minimizing an overall cost function through the candidate notes relative to the input musical score. The musical output is then constructed by concatenating the selected candidate notes. In further embodiments, the database of musical notes is generated from any desired musical genre, performer, performance, or instrument. Furthermore, notes in the database may be modified to better fit notes of the input musical score.

17 Claims, 5 Drawing Sheets

OTHER PUBLICATIONS

Diemo Schwarz. Data-Driven Concatenative Sound Synthesis. PhD Thesis in Acoustics, Computer Science, Signal Processing Applied to Music, Universite Paris 6—Pierre et Marie Curie, Jan. 20, 2004.*

Sven Konig. sCrAmBlEd?HaCkZ! Website: Concept. Apr. 25, 2006. <http://web.archive.org/web/20060425220027/http://www.popmodernism.org/scrambledhackz/?c=1>.*

Eliot Van Buskirk. Wired.com Commentary. Apr. 17, 2006. <http://www.wired.com/print/entertainment/music/commentary/listeningpost/2006/04/70664>.*

Schwarz, D. "A system for data-driven concatenative sound synthesis", DAFX00 Proceedings, Verona (It), Dec. 7-9, 2000.*

Zils, A., F. Pachet, "Musical Mosaicing" Proceedings of DAFX 01, Limerick (Ireland), 2001.*

Diemo Schwarz. "New developments in data-driven concatenative sound synthesis." In Proc. Int. Computer Music Conference, 2003.*

Diemo Schwarz. "The Caterpillar System for Data-Driven Concatenative Sound Synthesis." DAFX03 Proceedings, London, UK, Sep. 8-11, 2003.*

Diemo Schwarz. Current Research in Concatenative Sound Synthesis. International Computer Music Conference (ICMC). Barcelona, Sep. 2005.*

D. Schwarz, G. Beller, B. Verbrugghe, S. Britton. Real-Time Corpus-Based Concatenative Synthesis with CataRT >>, 9th International Conference on Digital Audio Effects (DAFx), Montreal, 2006.*

Schwarz, Diemo. "Concatenative sound synthesis: The early years" Journal of New Music Research 35.1 (Mar. 2006).*

Arcos, J.; De Mantaras, r., and Serra, X. "SaxEx: A Case-Based Reasoning System for Generating Expressive Musical Performances" Journal of New Music Research 27(3), pp. 194-210. 1998.

Derenyi, I, and Dannenberg, R. "Synthesizing Trumpet Performances." In Proceedings of the International Computer Music Conference. San Francisco: International Computer Music Association, pp. 490-496. 1998.

Hertzmann, A.; Jacobs, C.; Oliver, N.; Curless, B.; and Salesin, D "Image Analogies" In Eugene Fiume, editor, SIGGRAPH 2001, ComputerGraphics Proceedings, pp. 327-340. ACMPress / ACM SIGGRAPH, 2001.

Jojic, N., Frey, B., and Kannan, A.. "Epitomic Analysis of Appearance and Shape." In Proceedings of the InternationalConference on Computer Vision (ICCV), 2003.

Orio, N., and Schwarz, D. "Alignment of Monophonic and Polyphonic Music to a Score," in Proceedings of the ICMC, Havana, Cuba, 2001.

Raphael, C., Automatic Segmentation of Acoustic Musical Signals Using Hidden Markov Models. IEEE Transactions on Pattern Analysis and Machine Intelligence, 21(4):360-370, 1999.

Roucos, S., and Wilgus, A., "High Quality Time-Scale Modification for Speech." In Proceedings of the IEEE International Conference on Acoustics, Speech, and Signal Processing, pp. 493-496. IEEE, 1985.

Schwarz, D., "A System for Data-Driven Concatenative Sound Synthesis," in Digital Audio Effects (DAFx), Verona, Italy, 2000.

Zils, A., and Pachet, F., "Musical Mosaicing." in Proc. Cost G-6 Conf. Digital Audio Effects DAFX-01, Limerick, Ireland, 2001.

Jehan, T, "Creating Music by Listening" PhD Thesis, MIT, 2005. http://web.media.mit.edu/~tristan/Papers/PhD_Tristan.pdf.

Beller, G., Schwarz, D., Hueber, T., and Rodet, X, "A Hybrid Concatenative Synthesis System on the Intersection of Music and Speech" in Journées d'Informatique Musicale, Jun. 4, 2005, http://mediatheque.ircam.fr/articles/textes/Beller05c/.

The Singing Synthesis Software VOCALOID, http://www.vocaloid.com/en/introduction.html, Accessed Mar. 29, 2006.

Cantor: The vocal machine, http://www.virsyn.de/en/E_Products/E_CANTOR/e_cantor.html, Accessed Mar. 29, 2006.

* cited by examiner

CREATING MUSIC VIA CONCATENATIVE SYNTHESIS

BACKGROUND

1. Technical Field

The invention is related to music synthesis, and in particular, to automatic synthesis of music from a database of musical notes and an input musical score by concatenating an optimal sequence of candidate notes selected from the database.

2. Related Art

Techniques for synthesizing music sound are most commonly split into one of two categories, including "model-based synthesis" techniques and techniques based on "concatenative synthesis."

In general, "model-based synthesis" techniques use a "recipe" for creating sound from scratch, wherein new waveforms are generated with different qualities by modifying the parameters of the recipe. For example, one conventional model-based synthesis technique generates expressive performances of melodies from a model derived from examples of human performances. A related technique synthesizes instrumental music, such as a trumpet performance, by using a performance model that generates a sequence of amplitudes and frequencies from a music score in combination with an instrument model that is used to model the sound timbre of the desired instrument.

In contrast, concatenative synthesis is an idea that has typically been used in the field of speech generation, but has recently been applied to the field of music generation. In the context of speech generation, concatenative synthesis generally operates by using actual snippets or samples of recorded speech that are cut from recordings and stored in a database. Elementary "units" (i.e., speech segments or samples) are, for example, "phones" (a vowel or a consonant), or phone-to-phone transitions ("diphones") that encompass the second half of one phone plus the first half of the next phone (e.g., a vowel-to-consonant transition). Some concatenative synthesizers also use other more complex transitional structures. Concatenative speech synthesis then concatenates units selected from the voice database then outputs the resulting speech signal. Because concatenative speech synthesis systems use actual samples of recorded speech, they have the potential for sounding "natural."

In the context of musical sound synthesis, some concatenative synthesis schemes operate by using a database of existing sound, divided into "units," or "samples" with an output waveform being generated by placing these units or samples into a new sequence. For example, one conventional sound synthesis scheme uses concatenative synthesis to generate sound that represents a new realization of a musical score, played using sound samples drawn from a large database. In general, this scheme relies on a very large database of recordings to construct a great number of "sound events" in many different contexts, with a large emphasis being placed on an analysis of each sound event for extraction of features that are used in evaluating and selecting samples having the best fit transitions. Natural sounding transitions are then synthesized for a music score by selecting sound units containing transitions in a desired target context relative to the music score. Another conventional sound synthesis scheme provides a "musical mosaicing" approach that uses concatenative synthesis to automatically sequence snippets or samples of existing music from a large database to match a target waveform.

With any of the aforementioned concatenative synthesis based music generation techniques, score alignment is an important consideration. Consequently, one technique uses a dynamic time warping to find the best global alignment of a score and a waveform, while a related technique uses a hidden Markov model to segment a waveform into regions corresponding to the notes of a score.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A "Concatenative Synthesizer," as described herein, provides a unique method for generating a musical output from a database of musical notes and an input musical score based on a process of concatenative synthesis.

In various embodiments, the database of musical notes is generated from any desired musical score, or from a musical score in combination with one or more audio recordings representing any desired musical genre, performer, performance, or instrument recording. Furthermore, notes in the database may be modified (such as by changing the pitch, duration, etc.) to better fit notes of the input musical score. In addition, in one embodiment, the musical score accompanying an audio recording used to populate the database may be automatically generated by using conventional audio processing techniques to evaluate that recording to automatically construct the corresponding music score.

The input musical score is provided in a computer readable format, such as a conventional MIDI score, or any other desired computer readable musical score format. Furthermore, the input musical score may also be automatically generated by using conventional audio processing techniques to evaluate a musical recording to automatically construct the corresponding music score.

In general, the Concatenative Synthesizer begins operation by receiving a musical input score, either directly, or by processing an audio file to construct the score. The Concatenative Synthesizer then evaluates a database comprised of one or more sequences of one or more musical notes to identify a unique set of candidate musical notes for every note represented in the input musical score.

An "optimal path" through the candidate notes is then identified by minimizing an overall cost function of a path through the candidate notes relative to the input musical score. The musical output is then constructed by concatenating the selected candidate notes corresponding to the optimal path. In various embodiments, the musical output is a music score, an analog or digital audio file or music recording, or a music playback via conventional speakers or other output devices, as desired.

In view of the above summary, it is clear that the Concatenative Synthesizer described herein provides a unique system and method for generating a musical output given a musical input score and a database of musical notes. In addition to the just described benefits, other advantages of the Concatenative Synthesizer will become apparent from the detailed description that follows hereinafter when taken in conjunction with the accompanying drawing figures.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
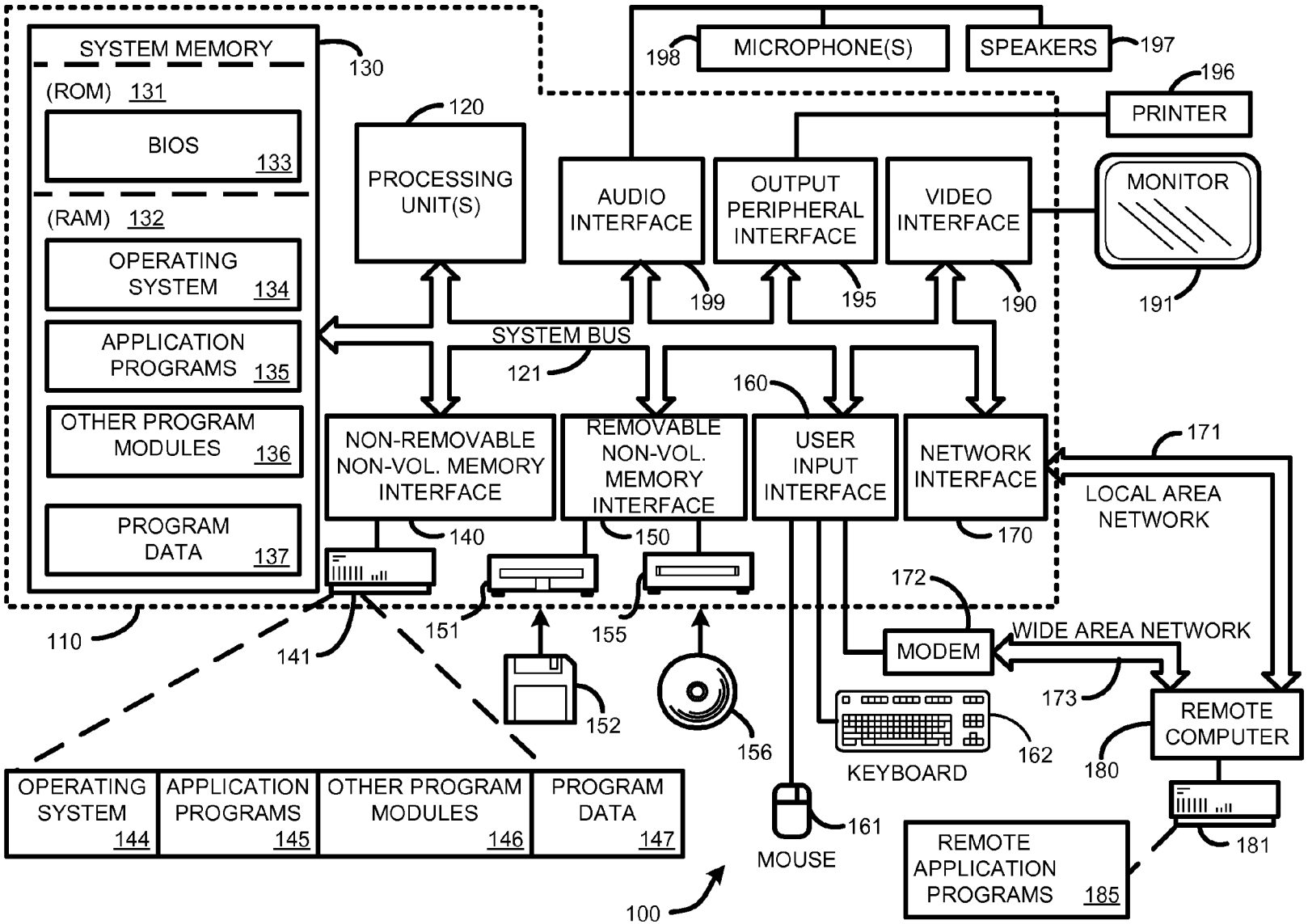
FIG. 1 is a general system diagram depicting a general-purpose computing device constituting an exemplary system implementing a "Concatenative Synthesizer," as described herein.
Figure 2:
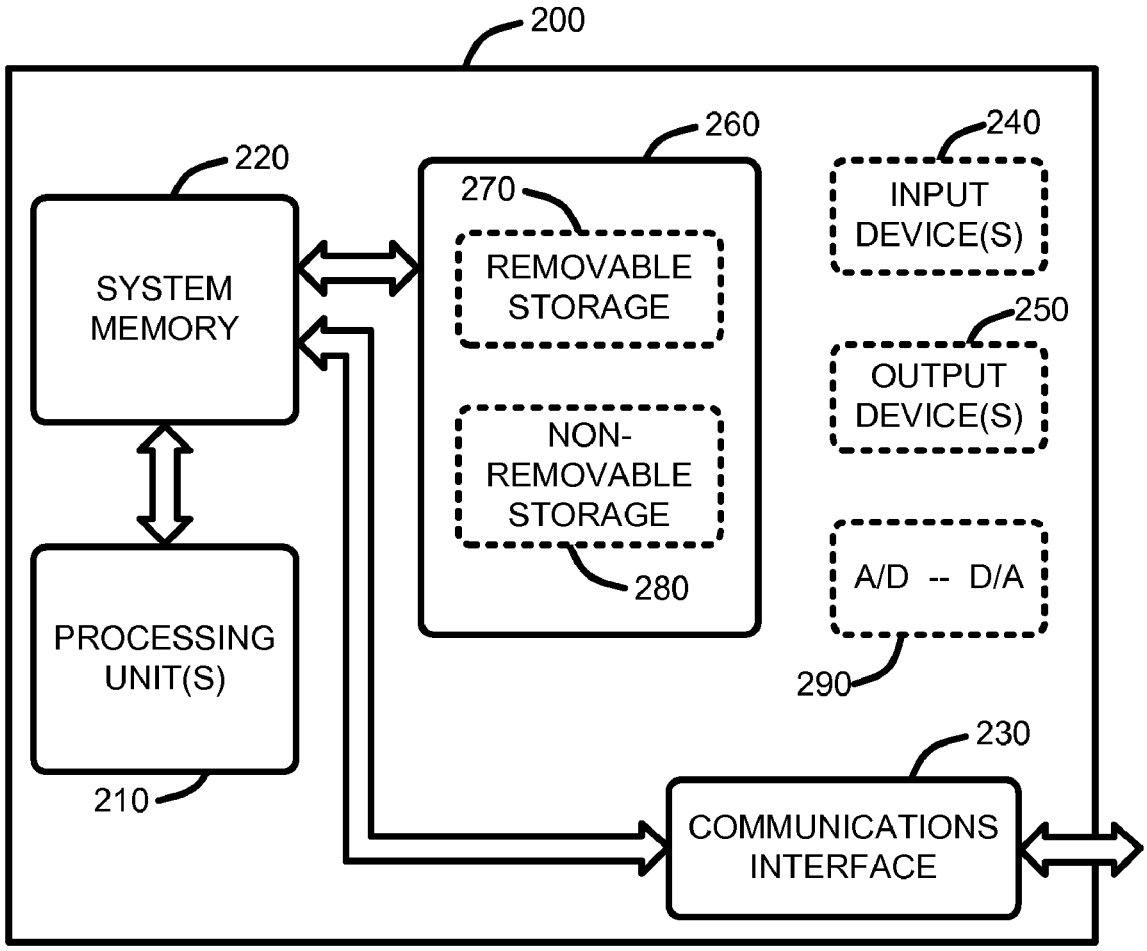
FIG. 2 is a general system diagram depicting a general device having simplified computing and I/O capabilities for use in implementing the Concatenative Synthesizer, as described herein.

1.0 Exemplary Operating Environments:

FIG. 1 and FIG. 2 illustrate two examples of suitable computing environments on which various embodiments and elements of a "Concatenative Synthesizer," as described herein, may be implemented.

For example, FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer in combination with various hardware modules. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile removable and non-removable media implemented in any method or technology for storage of information such as computer readable instructions, data structures, program modules, or other data.

Computer storage media includes, but is not limited to, RAM, ROM, PROM, EPROM, EEPROM, flash memory, or other memory technology; CD-ROM, digital versatile disks (DVD), or other optical disk storage; magnetic cassettes, magnetic tape, magnetic disk storage, or other magnetic storage devices; or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball, or touch pad.

Other input devices (not shown) may include a joystick, game pad, satellite dish, scanner, radio receiver, a television or broadcast video receiver, a piano-type musical keyboard, etc. These and other input devices are often connected to the processing unit 120 through a wired or wireless user input interface 160 that is coupled to the system bus 121, but may be connected by other conventional interface and bus structures, such as, for example, a parallel port, a game port, a universal serial bus (USB), an IEEE 1394 interface, a Bluetooth™ wireless interface, an IEEE 802.11 wireless interface, etc. Further, the computer 110 may also include a speech or audio input device, such as a microphone or a microphone array 198, as well as a loudspeaker 197 or other sound output device connected via an audio interface 199, again including conventional wired or wireless interfaces, such as, for example, parallel, serial, USB, IEEE 1394, Bluetooth™, etc.

A monitor 191 or other type of display device is also connected to the system bus 121 via an interface, such as a video interface 190. In addition to the monitor, computers may also include other peripheral output devices such as a printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device, or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets, and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

With respect to FIG. 2, this figure shows a general system diagram showing a simplified computing device. Such computing devices can be typically be found in devices having at least some minimum computational capability in combination with a communications interface for receiving input signals, including, for example, piano-type musical keyboards, cell phones, PDA's, dedicated media players (audio and/or video), etc. It should be noted that any boxes that are represented by broken or dashed lines in FIG. 2 represent alternate embodiments of the simplified computing device, and that any or all of these alternate embodiments, as described below, may be used in combination with other alternate embodiments that are described throughout this document.

At a minimum, to allow a device to implement the functionality of the Concatenative Synthesizer, the device must have some minimum computational capability, some storage capability, and a communications interface 230 for allowing data input/output. In particular, as illustrated by FIG. 2, the computational capability is generally illustrated by processing unit(s) 210 (roughly analogous to processing units 120 described above with respect to FIG. 1). Note that in contrast to the processing unit(s) 120 of the general computing device of FIG. 1, the processing unit(s) 210 illustrated in FIG. 2 may be specialized (and inexpensive) microprocessors, such as a DSP, a VLIW, or other micro-controller rather than the general-purpose processor unit of a PC-type computer or the like, as described above.

In addition, the simplified computing device of FIG. 2 may also include other components, such as, for example one or more input devices 240 (analogous to the input devices described with respect to FIG. 1). The simplified computing device of FIG. 2 may also include other optional components, such as, for example one or more output devices 250 (analogous to the output devices described with respect to FIG. 1). The simplified computing device of FIG. 2 also includes storage 260 that is either removable 270 and/or non-removable 280 (analogous to the storage devices described above with respect to FIG. 1). Finally, the simplified computing device of FIG. 2 may also include an analog-to-digital and/or digital-to-analog converter 290 for converting audio data input via the communications interface 230 to and from analog to digital, as necessary.

The exemplary operating environment having now been discussed, the remaining part of this description will be devoted to a discussion of the program modules and processes embodying a Concatenative Synthesizer that generates a musical output from a database of musical notes and an input musical score based on a process of concatenative synthesis.

2.0 Introduction:

A "Concatenative Synthesizer," as described herein, provides a unique method for generating a musical output from a database of musical notes and an input musical score based on a process of concatenative synthesis. Note that the term "notes" as used herein is intended to refer to both individual notes and to chords or any other simultaneous combination of notes.

In various embodiments, the aforementioned database of musical notes is generated from any desired musical score, or from one or more musical scores in combination with corresponding audio recordings representing any desired musical genre, performer, performance, or instrument recording. Note that this database generally represents a particular music "feel" or "texture" that the user wants to achieve, and as such, it is generally referred to herein as the "music texture database."

Further, since the music texture database is generated from any desired musical score and/or audio recording representing different musical genres, performers, performances, instrument recordings, etc., in one embodiment, separate user selectable music texture databases are presented to provide the user with a selection of "music textures" upon which to build the musical output from the input musical score.

It should also be noted that when a corresponding musical score is not available in combination with an audio recording that is evaluated to populate the music texture database, the corresponding music score is directly generated from that audio recording using conventional audio analysis techniques. Such score generation techniques are well known to those skilled in the art, and will not be described in detail herein.

The input musical score is provided in a computer readable format, such as a conventional MIDI score, or any other desired computer readable musical score format. Furthermore, the input musical score may also be automatically generated by using conventional audio processing techniques to evaluate an existing musical recording to automatically construct the corresponding input musical score. As noted above, such score generation techniques are well known to those skilled in the art, and will not be described in detail herein.

2.1 System Overview:

As noted above, the Concatenative Synthesizer described herein provides a unique method for generating a musical output from a database of musical notes and an input musical score based on a process of concatenative synthesis.

In general, the Concatenative Synthesizer begins operation by receiving an input musical score, either directly, or by processing an audio file to construct the score, and a database of musical notes (i.e., the music texture database). In various embodiments, the music texture database is either provided as a predefined "music texture," or is automatically constructed from one or more user provided sound samples.

The Concatenative Synthesizer then evaluates the music texture database to identify a unique set of candidate musical notes for every note represented in the input musical score. Furthermore, notes in the music texture database may be modified (such as by changing the pitch, duration, etc.) to better fit particular notes of the input musical score. There are a number of well known conventional techniques for changing the pitch and/or duration of audio signals such as musical notes, and as such, these note modification techniques will note be described in detail herein. Simple examples of such techniques include the use of conventional SOLA (synchronized overlap and add) techniques to change note duration or the use of conventional resampling techniques to change a note pitch.

An "optimal path" through the candidate notes is then identified by minimizing an overall cost function for picking the best path through the candidate notes relative to the input musical score. In various embodiments, the cost of each possible path through the candidate notes is computed using various factors, including, for example, a "match cost" for directly matching one note to another (i.e., a closeness metric that considers factors such as pitch and/or duration) and a "transition cost" for placing a particular candidate directly after the preceding candidate in the musical output. In addition, it should also be noted that while the optimal path is generally described in terms of minimizing the path cost, this minimum, or lowest cost, path may also be expressed in terms of maximizing the path cost by simply inverting the cost values when evaluating the various paths. Further, this path cost can also be expressed probabilistically, such that the match cost probability would be it's "goodness" (negative cost) and the transition probability would be the "transition goodness." In this case, the optimal path would be identified by maximizing the probability/goodness. In any case, each of these basic ideas are generally intended to be included in the overall concept of finding a best path through the candidates, as described herein.

Further, in a related embodiment, a user-adjustable scale factor provides an adjustable tradeoff between "accuracy" and "coherence," such that the musical output is either a more accurate match to the input musical score, or is more coherent (in terms of unit ordering) with respect to the original sounds used to construct the music texture database. This tradeoff is accomplished by scaling the match and transition costs as a function of the user adjustable scale factor. Note that this embodiment is described in further detail in Section 3.5.

Once the optimal path has been identified, the musical output is then constructed by concatenating the selected candidate notes corresponding to the optimal path. In various embodiments, the musical output is a music score, an analog or digital audio file or music recording, or a music playback via conventional speakers or other output devices, as desired.

For example, assume that the Concatenative Synthesizer is provided with an example pair (A, A') of data inputs, where A represents a MIDI score (or other score format), and A' represents the corresponding waveform (or audio file). The user then provides the Concatenative Synthesizer with the input musical score (B) which will be used to produce the musical output B', where B' is a realization of MIDI score B using the "texture" of the input waveform A'. In other words, given musical scores A and B, and a sound clip A' corresponding to A, the Concatenative Synthesizer will create a new sound clip B' that is the realization of MIDI score B, where the relationship between B and B' approximates the relationship between A and A' as closely as possible. Note that "closeness" can have a continuum of senses, from perfectly reproducing the score of B using sounds from A' to perfectly preserving coherence in the samples drawn from A' at the expense of manipulating the score of B.

Alternately, in a related embodiment, instead of constructing a musical output relative to a particular instrument, the Concatenative Synthesizer constructs a modification of a musical score by replacing notes in B with notes or note sequences from A that reflect the phrasing of a certain musical style or performer to output a new score $B_{new}$. These concepts will be discussed in further detail in the following sections.

Figure 3:
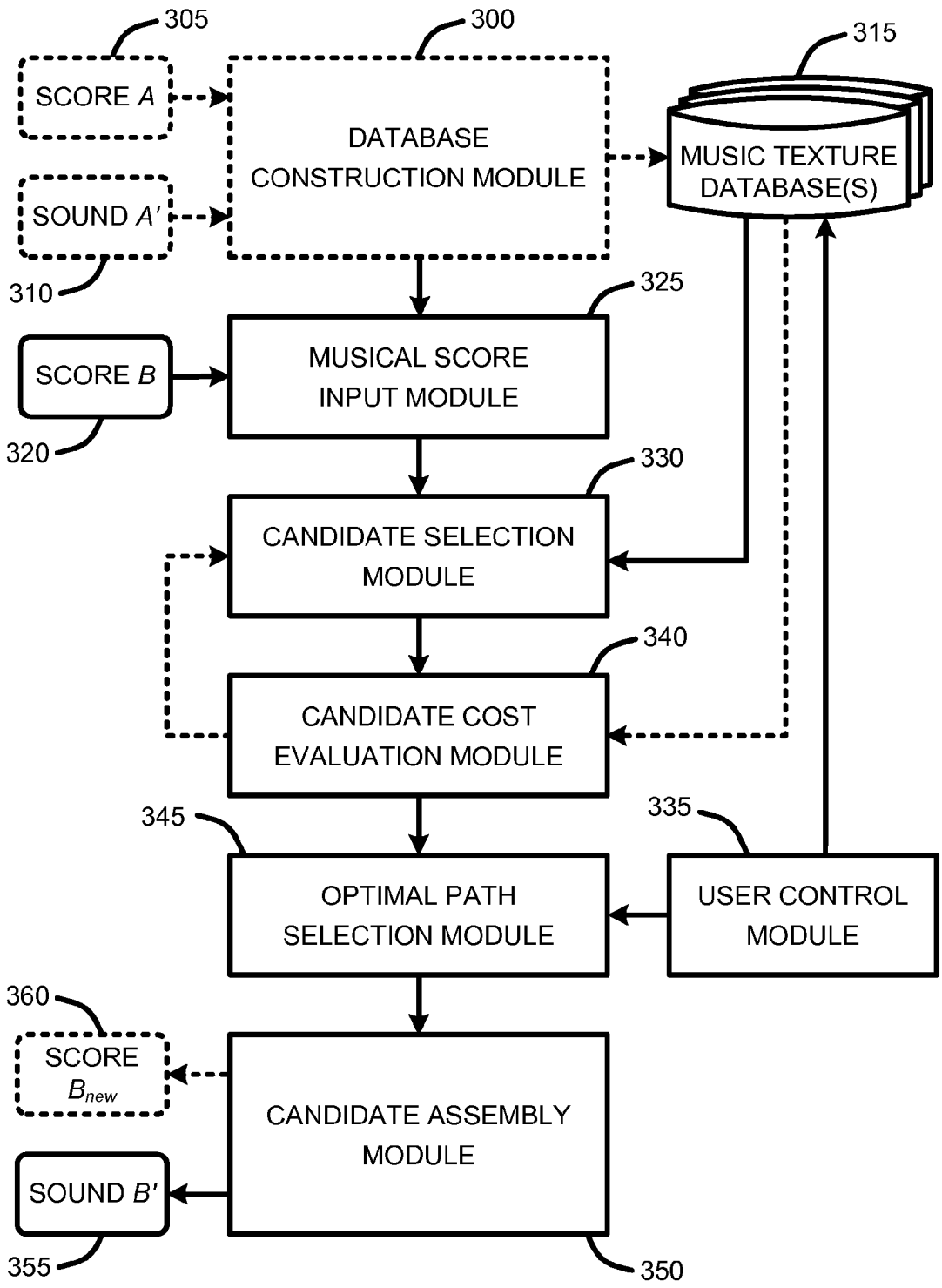
FIG. 3 provides an exemplary architectural flow diagram that illustrates program modules for implementing the Concatenative Synthesizer, as described herein.

2.2 System Architectural Overview:

The processes summarized above are illustrated by the general system diagram of FIG. 3. In particular, the system diagram of FIG. 3 illustrates the interrelationships between program modules for implementing the Concatenative Synthesizer, as described herein. It should be noted that any boxes and interconnections between boxes that are represented by broken or dashed lines in FIG. 3 represent alternate embodiments of the Concatenative Synthesizer described herein, and that any or all of these alternate embodiments, as described below, may be used in combination with other alternate embodiments that are described throughout this document.

In general, as illustrated by FIG. 3, the Concatenative Synthesizer begins operation by receiving one or more music texture databases 315 selected via a user control module 335. As noted above, these music texture databases each represent different musical genres, performers, performances, instrument recordings, etc. that are to be emulated in constructing the musical output. Each of these music texture databases 315 is either predefined, or is automatically constructed by a database construction module 300 given a sound sample A' 310, and possibly a corresponding musical score A 305. Note that if the corresponding musical score A 305 is not provided, it is automatically extracted from the sound sample A' 310 by the database construction module 300.

Next, an input musical score B 320 is provided or selected by the user via a musical score input module 325. A candidate selection module then evaluates entries in the selected music texture database 315 to identify a set of candidate notes for each note of the input musical score B 320. In general, each acceptable candidate represents a potential match to a particular note of the input musical score B 320. Assuming that the size of the selected music texture database 315 is not too large, every sample in the database is selected as a candidate for every note in the input musical score B 320.

However, given that the computational overhead of choosing an optimal path through the candidate notes will increase with the number of candidates for each note, in an alternate embodiment, a predefined maximum number (k) of most closely matching candidates are selected for each note in the input musical score B 320. In this case, a candidate cost evaluation module 340 first determines a match cost ($c_{match}$) for directly matching one note to another based on the pitch and duration of each candidate relative to every note in the input musical score B 320. These match costs are then used to select the k best candidates for each note of the input musical score B 320.

In either case, the candidate cost evaluation module 340 then computes the match cost ($c_{match}$) for each candidate (if not already computed) and a transition cost ($c_{transition}$) for placing a particular candidate directly after preceding candidate in the musical output.

Next, an optimal path selection module 345 evaluates the candidates in terms of their costs ($c_{match}$ and $c_{transition}$) to identify a best path through the candidates relative to the input musical score B 320. However, as noted above, in one embodiment, the user adjustable cost scaling factor ($\alpha$) is input or adjusted via the user control module 335 for scaling the match and transition costs. This scaling of the match and transition costs ($c_{match}$ and $c_{transition}$) causes the best path through the candidates to vary from one extreme, wherein the resulting output music is the most accurate match to the input musical score B 320, to the other extreme, wherein the resulting output music is more coherent with respect to the original sounds used to construct the music texture database 315. See Section 3.5 for additional discussion regarding the use of the user adjustable $\alpha$ value.

Next, a candidate assembly module 350 uses concatenative synthesis to combine the sequence of notes from the music texture database 315 corresponding to the optimal path. Finally, the candidate assembly module 350 then outputs either an audio music output sound B' 355, or a new music score $B_{new}$ 360, or both.

3.0 Operation Overview:

The above-described program modules are employed for implementing the Concatenative Synthesizer. As summarized above, the Concatenative Synthesizer generates a musical output from a database of musical notes and an input musical score based on a process of concatenative synthesis. In general, the Concatenative Synthesizer focuses on high quality music synthesis from a single example instrument. However, as noted above, this music synthesis may be based on example inputs from one or more particular performers, different genres, song collections, etc. In other words, the music synthesis is based on whatever musical input is used to construct the music texture database. However, the more focused the input to the music texture database, the more that the final music output will correspond to the particular performer, genre, instrument, etc., that is represented by the music texture database.

The following sections provide a detailed discussion of the operation of the Concatenative Synthesizer, and of exemplary methods for implementing the program modules described in Section 2 with respect to FIG. 3.

3.1 Operational Details of the Concatenative Synthesizer:

The following paragraphs detail specific operational and alternate embodiments of the Concatenative Synthesizer described herein. In particular, the following paragraphs describe definitions of terms used to implement an operational embodiment the details of the Concatenative Synthesizer; data structures; and path construction for generation of musical outputs. Following the detailed description of the aforementioned features of the Concatenative Synthesizer, an operational flow diagram is described in Section 4, with respect to FIG. 6, which summarizes the overall operation of various generic embodiments of the Concatenative Synthesizer in view of the following detailed description.

3.2 Variable Definitions:

The terms defined below represent variables that are used for a description of various embodiments of the Concatenative Synthesizer. It should be appreciated that in view of the following discussion, not every described variable described below is required for operation of the Concatenative Synthesizer. Further, it should be clear that different variable definitions may be used without departing from the intended scope of the Concatenative Synthesizer.

(A, A') is the input example pair used to construct the music texture database, where A is a musical score (such as a MIDI file), and A' is the corresponding waveform. As noted above, in one embodiment, A may be derived from A' if A is not directly available.

B is the input musical score that represents the music that the user wants to "texture" using the selected music texture database B' is the musical output waveform $B_{new}$ is the musical output score

|A| is the total number of frames (consecutive notes or note sequences) that make up A $a_i$ is the $i^{th}$ frame of A $a'_i$ is the $i^{th}$ frame of A'

$b_i$ is the $i^{th}$ frame of B $b'_i$ is the $i^{th}$ frame of B'

$z_i^j$ is the $j^{th}$ candidate from the music texture database for frame $b_i$, where the candidate $z_i^j$ is a frame from A' that may be optionally transformed (pitch and/or duration) to better match $b_i$ r(i,j) is the index of the frame in A' that is used to construct candidate $z_i^j$. In other words, $z_i^j$ is constructed from $a'_{r(i,j)}$ k is the number of candidates for each frame $b_i$ $c_{match}(i,j)$ is the cost of matching candidate $z_i^j$ with frame $b_i$ in B. This is the "match cost" of using $z_i^j$ as the $i^{th}$ frame of B', independent of all other frames in B'

$c_{transition}(i,j,k)$ is the cost of placing candidate $z_{i+1}^k$ directly after candidate $z_i^j$ in B'. This is the "transition cost" between these two frames $\alpha$ is the weight, between 0 and 1, applied to match costs ($c_{match}(i,j)$) as opposed to transition costs ($c_{transition}(i,j,k)$), which are weighted by $1-\alpha$.

3.3 Data Structures:

In addition to the three inputs described above (A, A', and B), the Concatenative Synthesizer uses several intermediate data structures for generating the musical output B'. In particular, intermediate data structures employed by the Concatenative Synthesizer include:

$M_{cost}$, which is a $|B|\times k$ matrix of costs used in determining the optimal path through the candidates. In particular, $M_{cost}[i,j]$ represents a total cost of the optimal sequence of frames 1 to i of B' in which $b'_i=z_i^j$ $M_{index}$, which is an $n\times k$ matrix of indices used in determining the optimal path through the candidates. In particular, $M_{index}[i,j]$ hods the index k for which $b'_{i-1}=z_{i-1}^k$ in the optimal sequence of frames 1 to i of B', where $z_{i-1}^k$ is the predecessor frame of $z_i^j$ in the optimal sequence 3.4 Path Construction for Generation of Musical Outputs:

In view of the definitions of variables and data structures provided above, the following paragraphs detail specific operational and alternate embodiments of the Concatenative Synthesizer described herein. In particular, the following paragraphs describe steps for: construction of the music texture database and segmentation of the notes of the A, A', and B into frames; choosing candidates for each frame of B; computing costs for each candidate; evaluating the cost and index matrices ($M_{cost}$ and $M_{index}$) to compute a globally optimal path through the candidates; and generating the musical output from notes corresponding to the optimal path.

3.4.1 Music Texture Database and Note Segmentation:

As noted above, the music texture database is generated from a musical audio sample A' and a corresponding musical score A by segmenting those inputs into frames. Again, it should be noted that the corresponding musical score A can be automatically constructed from the musical audio sample A' using conventional techniques.

In general, any piece of music played by a human musician will never be perfectly aligned with the original musical score that defines that piece of music. Consequently, given the musical audio sample A' and the corresponding musical score A, improved segmentation results will be achieved by first aligning A and A'. In particular, a near-perfect alignment helps to minimize a problem wherein sound data from other notes in A' manages to seep into the musical output, thereby causing audible "grace note" artifacts in the output waveform.

Figure 4:
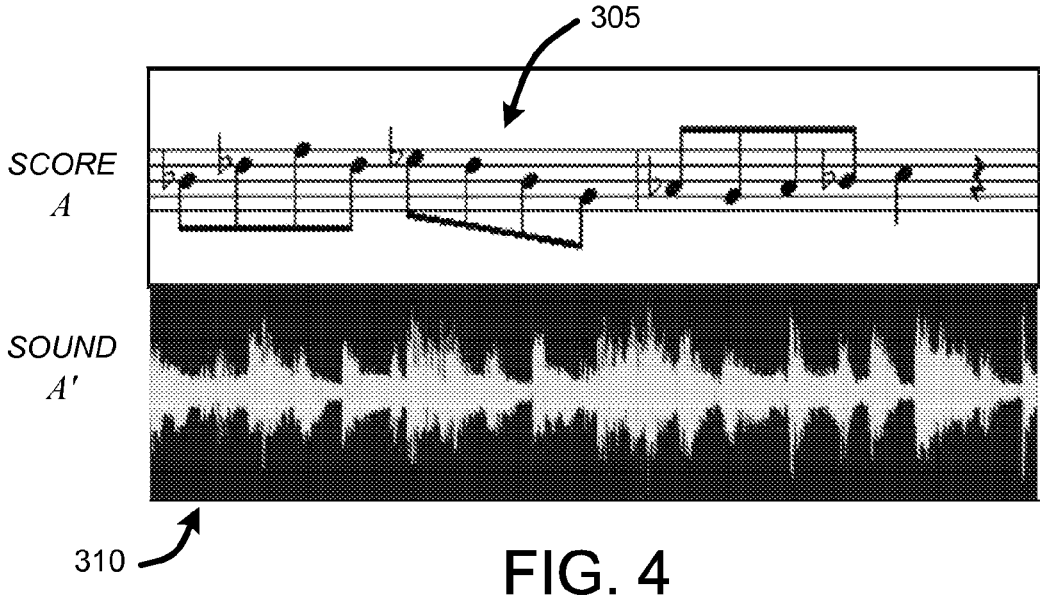
FIG. 4 illustrates an exemplary sample music score and a corresponding waveform used for constructing a "music texture database" for use in implementing the Concatenative Synthesizer, as described herein.

The process for aligning A and A' uses conventional techniques, such as, for example, manual labeling, pitch tracking, or other automatic methods, for detecting note boundaries in A', then modifying the duration and onset times for the notes of score A to accurately reflect the actual note boundaries. Then, since the musical score A is accurately aligned to the musical audio sample A', segmentation of the inputs A and A' into frames is straightforward. FIG. 4 provides a simple graphical example of an aligned musical score A 305 and a musical audio sample A' 310.

In particular, to segment the inputs, the Concatenative Synthesizer breaks each audio and musical score input into discrete frames. As such, three types of frames are considered:

1. "score frames"—Score frames are the original frames from input scores A and B. Each score frame is simply a vector of note properties that are segmented from the score based on note onset times and note duration. Other elements, including note pitch and velocity (a MIDI parameter representing how hard the note is struck) may also be considered.
2. "candidate frames"—Candidate frames are similar to score frames, but are used as potential matches for the score frames of B. Each candidate frame contains a vector of note data, as well as a reference or index to a score frame in A.
3. "wave frames"—Wave frames (or audio sample frames) are only used when actually constructing the musical output B'. Each wave frame corresponds to a candidate frame, and is basically a raw sound sample extracted from the musical audio sample A' as a function of the onset and duration values of the corresponding musical score.

In general, a single frame (of any of the aforementioned types) corresponds to a single note (or rest, which can be treated the same as a note). However, it should be appreciated that sequences of notes can also be used in place of individual notes where sequences of notes in B may correspond to sequences of notes in A. In this case, the segmentation into frames may be performed an individual note basis and/or on a note sequence basis. Matching sequences may then be treated as individual notes for purposes of determining the optimal path through the candidate frames.

It should also be noted that segmentation of the audio input A' can also be virtual rather than actual. In other words, rather than maintaining separate samples for every segmented frame, pointers to the frame positions within the original audio input A' can be maintained in order to provide access to the individual frames, as needed.

In one embodiment, after the frame segmentation points have been determined, the input musical score B is modified to make matches with A more likely. In particular, the input musical score B is transposed so that it has maximal overlap with A in terms of pitch values. This is as simple as trying all possible transpositions of the notes of B, and keeping the one which has the most pitch overlaps with A. In addition, the tempo of B is uniformly modified so that the median note durations of B and A are the same. Other musical score tempo distance metrics may also be used, if desired, to provide the uniform tempo change.

3.4.2 Candidate Selection:

As noted above, once the input frames have been segmented, the next step is to choose the candidates $z_i^j$ for each target frame $b_i$ of the input musical score B. Assuming the musical texture database is small enough, or the computer processing time is not a primary concern, $z_i^j$ is constructed from note $a'_j$ for all j. In other words, $k=|A|$ candidates are used to populate $z_i^j$ for each frame $b_i$, and $r(i,j)=j$. In one embodiment, the pitch and/or duration of each candidate is also transformed to match the pitch and duration of $b_i$.

In the case where the music texture database is very large, computation of an optimal path through the candidates in a reasonable amount of time requires a reasonable limitation on the number of candidates. Consequently, in one embodiment, a predefined or user adjustable value for $k<|A|$ is used. In this case, the best k candidates for each frame $b_i$ are selected with respect to $c_{match}$ in order to populate $z_i^j$ for each frame $b_i$.

3.4.3 Cost Computation:

Once the audio input A' has been split into frames, and the candidates identified for each frame $b_i$ of B, the values of $c_{match}$ and $c_{transition}$ are computed for every candidate for each frame. In order to compute these scores, it is necessary to consider the cost of transforming a frame (pitch and/or duration), i.e., $c_{match}$, and and the cost of placing two candidate frames in succession, i.e., $c_{transition}$. There are many factors that can be considered in "scoring" these elements. Consequently, it should be understood that the Concatenative Synthesizer is not intended to be limited to computation of these costs in the manner described in this section, and that the costs described below are provided solely for purposes of example and explanation.

For example, in a tested embodiment, the Concatenative Synthesizer computed scores based on distance metrics, where the function $d_{transform}(s_1,s_2)$ represents the cost of transforming from frame $s_1$ to frame $s_2$ (such as by using SOLA for pitch modification and resampling for duration modification), and the function $d_{transition}(s_1,s_2)$ represents the cost of placing two frames (frame $s_1$ and frame $s_2$) in succession. Given these functions, $c_{match}$ and $c_{transition}$ can be computed as follows:

$$c_{match}(i,j)=d_{transform}(a_{r(i,j)},z_i^j) \quad \text{Equation 1}$$

$$c_{transition}(i,j,k)=d_{transition}(z_i^j,z_{i+1}^k) \quad \text{Equation 2}$$

In a tested embodiment, $d_{transform}(s_1,s_2)$ was determined as a weighted function of the pitch and duration change. Note that any desired function of the pitch and/or duration can be used here. For example, in a tested embodiment, $d_{transform}(s_1, s_2)$ was determined as follows:

$$d_{transform}(a_{r(i,j)}, z_i^j) = \beta|\text{pitch}(z_i^j)\log(\text{duration}(z_i^j)) - \text{pitch}(a_{r(i,j)})\log(duration(a_{r(i,j)}))| + \gamma|\text{pitch}(z_i^j) - \text{pitch}(a_{r(i,j)})| \quad \text{Equation 3}$$

The first term in the sum illustrated in Equation 3 is the cost of changing the duration of a note (i.e., using SOLA) and is proportional to the logarithm of the ratio of the durations. Note that pitch terms are also included, since the pitch is changed before applying SOLA. The second term illustrated in Equation 3 is the cost of changing the pitch of a note using resampling, and is proportional to the difference in pitch (or the logarithm of the ratio of the frequencies). Note that the β and γ terms illustrated in Equation 3 are optional variables that allow the user to place relative weights on the pitch modification and resampling terms, if desired.

Similarly, in a tested embodiment, $d_{transition}(s_1,s_2)$ was determined as a weighted function of the pitch of the note candidates—note that the duration doesn't appear here because it is already covered in the match cost. Note that any desired function of the pitch can be used here. For example, in a tested embodiment, $d_{transition}(s_1,s_2)$ was determined as follows:

$$d_{transition}(z_i^j, z_{i+1}^k) = \begin{cases} 1 & \text{if } r(i+1,k) = r(i,j)+1 \text{ and } \text{pitch}(a_{r(i,j)}) - \text{pitch}(b_i) = \text{pitch}(a_{r(i+1,k)}) - \text{pitch}(b_{i-1}) \\ \lambda & \text{if } r(i+1,k) = r(i,j)+1 \text{ but } \text{pitch}(a_{r(i,j)}) - \text{pitch}(b_i) \neq \text{pitch}(a_{r(i+1,k)}) - \text{pitch}(b_{i+1}) \\ \lambda+\mu & \text{if } r(i+1,k) \neq r(i,j)+1 \end{cases} \quad \text{Equation 5}$$

The transition cost defined in Equation 5 is straightforward. In particular, if the two consecutive candidates do not come from two consecutive frames of A (i.e., r(i+1,k)≠r(i,j)), then a cost of λ+μ is incurred, where λ and μ are greater than 1. On the other hand, if the two candidates come from consecutive frames, but must be resampled at different rates to match the target pitch, a cost of λ is incurred. Finally, if the two candidates come from consecutive frames, and are transposed by the same interval, no cost is incurred. Note that this cost function for $d_{transition}$ means that sequences that include more sets of consecutive frames from A have a lower cost than those that contain fewer such sets. This acts to improve the coherence of the resulting $B_{new}$ and or B', since when adjacent frames in B' come from adjacent frames in A', the transition will sound more "natural" since in fact it is coming directly from the original.

In a related embodiment, the transition cost can also be lower when candidate notes have matching "note contexts," as opposed to necessarily being adjacent in the original score. For instance, if the desired note transition is "C to G" and the first candidate is followed by a "G" and/or the second candidate is preceded by a "C", even though they are not adjacent in the score, they still have the same note transition. More formally, if $\text{pitch}(a_{r(i,j)+1})=\text{pitch}(a_{r(i+1,k)})$ and/or $\text{pitch}(a_{r(i,j)})=\text{pitch}(a_{r(i+1,k)-1})$, the cost could be between 1 and λ+μ.

Figure 5:
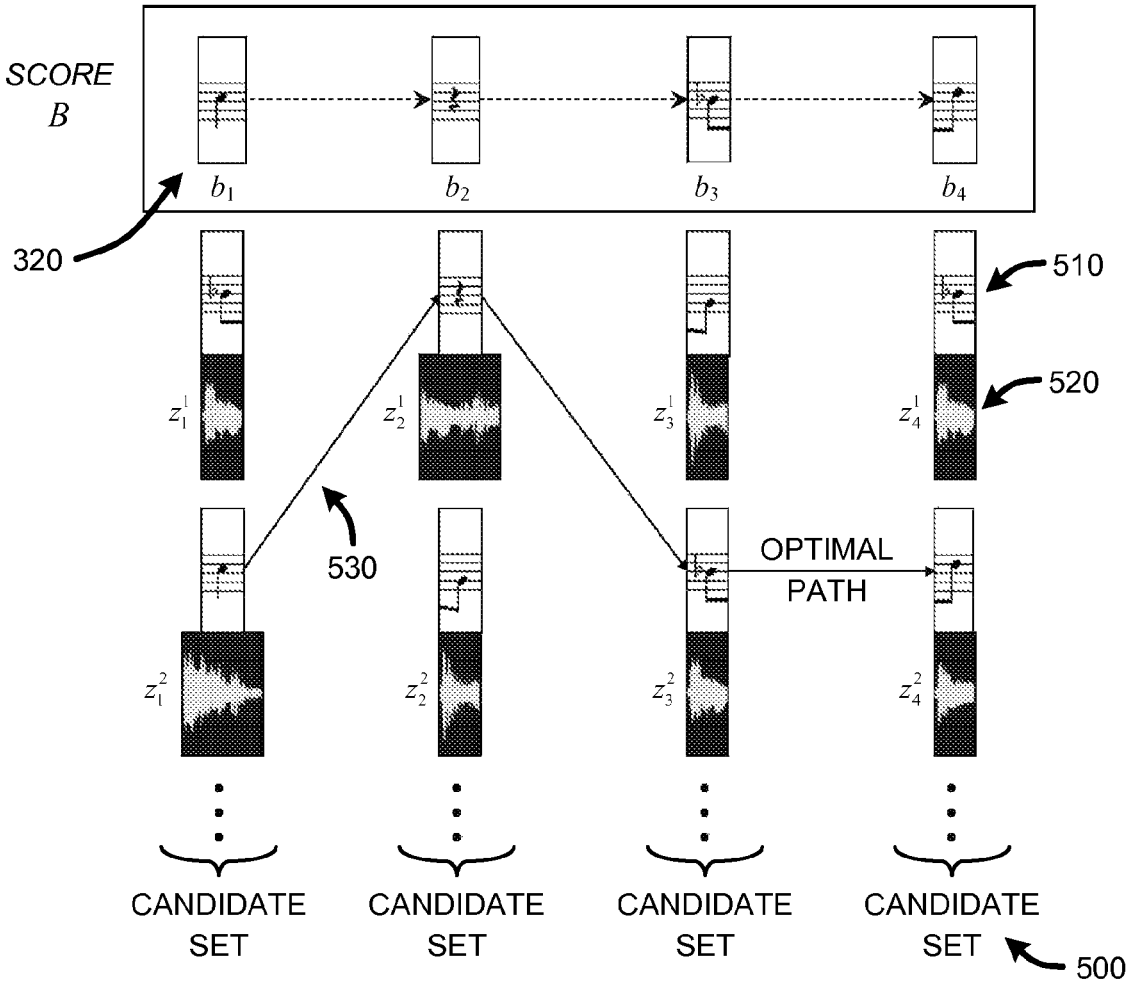
FIG. 5 illustrates an exemplary input musical score and corresponding candidate note sets showing an optimal path through the candidate note sets for generating a musical output, as described herein.

3.4.4 Computing a Globally Optimal Path:

In general, once the costs have been computed for each candidate, the next step is to compute a globally optimal path through those candidates. FIG. 5 provides a graphical example of this process. In particular, as illustrated by FIG. 5, each frame $b_i$ in score B 320 has an associated set 500 of candidate frames constructed from A and A' (e.g., candidate score note 510 and corresponding audio sample 530). Given these candidates sets, for each frame in B, the Concatenative Synthesizer computes the lowest cost sequence ending in each of its candidates. Then, starting with the last frame (i.e., frame |B|), the Concatenative Synthesizer computes the optimal sequence in reverse. Further, as noted above, while the optimal path is generally described in terms of minimizing the path cost, this minimum, or lowest cost, path may also be expressed in terms of maximizing the path cost by simply inverting the cost values when evaluating the various paths. Further, this path cost can also be expressed probabilistically, such that the match cost probability would be it's "goodness" (negative cost) and the transition probability would be the "transition goodness." In this case, the optimal path would be identified by maximizing the probability/goodness. In any case, each of these basic ideas are generally intended to be included in the overall concept of finding a best path through the candidates, as described herein.

As noted above, the musical output B' is constructed using a sequence of frames from A'. Each frame in the sequence should match the corresponding frame in B (i.e., minimize match cost), and the sequence should be coherent with respect to A' (i.e., minimize transition cost). Given the above-describes cost functions for these two objectives, and the value $\alpha$ (i.e., the user adjustable scaling factor described in Section 3.5), the optimal sequence is well-defined, and can be computed with a dynamic programming algorithm.

For example, given $c_{match}$, $c_{transition}$, and the value $\alpha$, the Concatenative Synthesizer computes a globally optimal sequence S of frame indices from A', where the optimal sequence minimizes the following quantity:

$$\alpha\sum_{i=1}^{n} c_{match}(i, S_i) + (1-\alpha)\sum_{i=1}^{n-1} c_{transition}(i, S_i, S_{i+1}) \quad \text{Equation 6}$$

This type of minimization problem can be solved using conventional minimization techniques, such as, for example, a Viterbi algorithm. In this case, for each frame $b_i$ in B, the Concatenative Synthesizer first computes the cost of the set of candidates to match $b_i$ ($z_i^j$). It then computes the transition cost $d_{transition}$ between each candidate $z_i^j$ and $z_{i+1}^k$. Once the costs have all been determined, the algorithm goes from the first frame to the last, at each point computing for each candidate the minimum cumulative cost to get to that candidate from any candidate from the previous frame, as well as a "backpointer" to the candidate in the previous frame that resulted in this lowest cost. When this process reaches the final frame, the optimal sequence is decoded by taking the candidate in the final frame with the lowest cumulative cost, and then following the backpointers recursively back to the first frame. This is an application of the Viterbi algorithm, and is illustrated in FIG. 5.

3.4.5 Construction of Musical Output:

As noted above, the musical output of the Concatenative Synthesizer is either a waveform (or other audio recording or file) or is a new musical score. In the case of a new musical score, the musical output score $B_{new}$ is simply the input musical score B transformed as described above during computation of the optimal path.

In the case of an audio output B', it is necessary to construct a new waveform (or other audio recording or file) from the frames of the musical texture database that correspond to the optimal path described above. In particular, given selected candidate $z_i^j$ for frame $b_i$, and the frame $a'_{r(i,j)}$ from which the sound data is to be taken, the Concatenative Synthesizer optionally transforms the sound data of the selected candidate to match the pitch and duration specified for frame $b_i$. As noted above, pitch modification and duration modification is accomplished using conventional techniques such as the use of resampling for changing the pitch of the waveform and the use of SOLA to change the duration of the waveform representing the frame.

As is known to those skilled in the art, SOLA is a technique for changing the duration of a signal independent of the pitch. The signal is broken up into overlapping segments, which are then shifted relative to each other and added back together. The desired signal length determines the amount by which the segments are shifted. In addition, the segments should be shifted to align the signal optimally, which can be measured by cross-correlation.

In general, the use of conventional SOLA techniques yield good results as long as the ratio of original signal length to new signal length is not too large or small. Generally, ratios between 0.9 and 1.1 sound very good for all sounds, but any ratio between 0.5 and 2 sound reasonable with respect to periodic signals. Since the core part of most instrument sounds (excepting the initial "attack" and final "decay") are approximately periodic, with a large enough (A', A) pair, it should usually be possible to find a candidate whose original signal length is close enough to the target signal length. In addition, SOLA results can be improved by stretching some portions of a note while leaving others alone. For example, in one embodiment, the "attack" of a note is left alone during SOLA processing, as the attack portion of a note typically contains energy at too many frequencies for good signal alignments to be found after shifting.

Finally, once the selected candidates have been optionally transformed, the sequence of frames corresponding to the candidates along the optimal path are simply concatenated to construct the output waveform. Note that in one embodiment, conventional audio concatenation techniques are used to prevent audible discontinuities at the junction between frames. Such techniques include cross fading the frames, weighted or windowed blending, shifting the frames with respect to each other to maximize the cross-correlation, etc.

3.5 Musical Texture Adjustments:

As noted above, in one embodiment, a user adjustable $\alpha$ value is provided to allow the user to customize the sound of the musical output constructed by the Concatenative Synthesizer. In general, this $\alpha$ value allows the user to customize the "texture" of the musical output.

For example, in the domain of image processing, texture transfer generally refers to the problem of texturing a given image with a sample texture. For music, a natural analogue is to play one piece using the style and phrasing of another (i.e., the musical "texture" of a particular instrument, artist, genre, etc.). In one embodiment, the Concatenative Synthesizer allows the user to control the extent to which musical "texture" is transferred from a musical input to a musical output as a function of an input musical score. At one extreme, the musical score is interpreted rigidly, and its notes are played exactly, with the best matches to the musical score being selected from the music texture database. At the other extreme, the input musical score is given less weight when choosing matches from the music texture database.

In this approach, there is a fundamental tradeoff between accuracy and coherence. The more faithful B' is to B, the less likely it is that B' is coherent with respect to A'. Conversely, the more coherent B' is with respect to A', the less likely it is that B' is an accurate transformation of B. In a tested embodiment, the Concatenative Synthesizer uses a value $\alpha$, between 0 and 1, to express this tradeoff. Values closer to 1 mean that B' should match B more closely, while values closer to 0 mean that B' should incorporate more of the style of A'. So, at the most general level, the input to the Concatenative Synthesizer is an example pair (A, A') representing the music texture database, a new score B provided by the user, and the parameter $\alpha$, with the output of the Concatenative Synthesizer being a new waveform B' (and/or a new musical score $B_{new}$).

In one embodiment, this concept is implemented in an electronic piano keyboard or the like with an "auto-stylization" dial. As a performer plays a piece of music, he/she can adjust this dial to control the $\alpha$ value of the sound coming from the keyboard relative to a user selectable music texture database. In other words, this embodiment provides users with a variable control for "importing" musical styles from other performers, genres, instruments, etc., into a new piece of music.

For example, the Concatenative Synthesizer described herein, when applied to music score realization, presents a balance between playing "Paul Desmond's saxophone", and "playing Paul Desmond's saxophone like Paul Desmond."

This balance can be thought of as controlling the amount of "texture transfer" that takes place when constructing the musical output.

Figure 6:
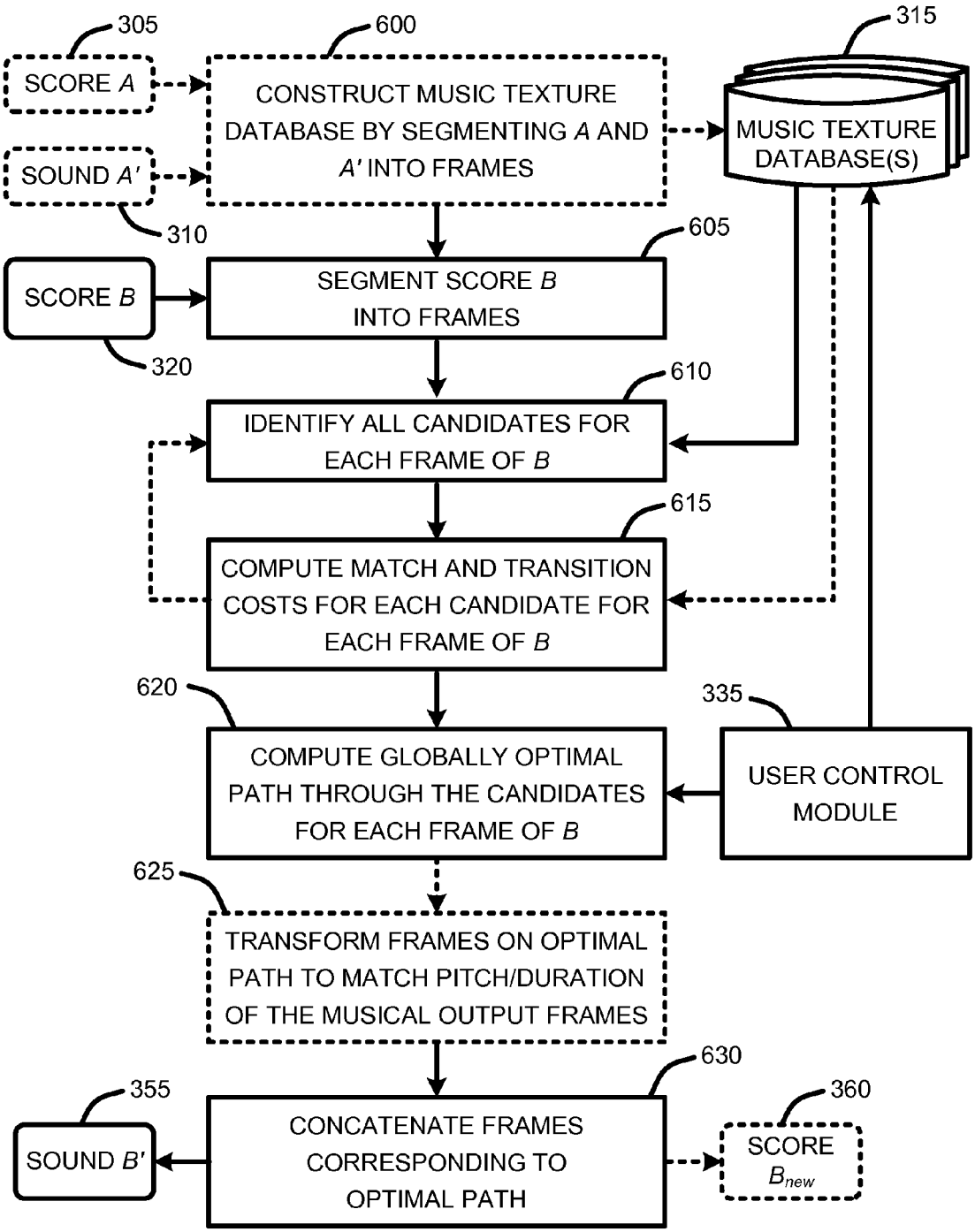
FIG. 6 provides an exemplary operational flow diagram illustrating general operation of one embodiment of the Concatenative Synthesizer, as described herein.

4.0 Concatenative Synthesizer Operational Embodiments:

The processes described above with respect to FIG. 1 through FIG. 5 are summarized with respect to the general operational flow diagram of FIG. 6. In general, FIG. 6 illustrates an exemplary operational flow diagram showing generic operational embodiments of the Concatenative Synthesizer. It should be noted that any boxes and interconnections between boxes that are represented by broken or dashed lines in FIG. 6 represent alternate embodiments of the Concatenative Synthesizer described herein, and that any or all of these alternate embodiments, as described below, may be used in combination with other alternate embodiments that are described throughout this document.

In general, as illustrated by FIG. 6, the Concatenative Synthesizer begins operation by optionally constructing 600 one or more music texture databases 315 from one or more musical inputs comprising a music sound sample A' 310, and a corresponding musical score A 305. Construction 600 of the music texture databases 315 is generally accomplished by aligning the musical inputs A' 310 and A 305, and then segmenting those musical inputs into pairs of frames (each pair including a score note and a corresponding audio sample). Alternately, the music texture databases 315 are predefined. In either case, the desired music texture databases 315 are selectable via the user control module 335.

Next, an input musical score B 320 is also segmented 605 into frames. All possible candidate frames from the selected music texture database 315 are then identified 610 for each frame of the input musical score B 320. As discussed above, assuming that the size of the selected music texture database 315 is not too large, every sample in the database is selected as a candidate for every frame in the input musical score B 320. Alternately, the number of possible candidates is limited by a user adjustable or predefined maximum value (k).

Once the candidates have been identified 610, match and transition costs, $c_{match}$, and $c_{transition}$, respectively, are computed for each candidate for each frame of the input musical score B 320.

Next, a globally optimal path is computed 620 through the candidate sets corresponding to each frame of the input musical score B 320. As noted above, in one embodiment, the user control module allows the user to weight the costs ($c_{match}$, and $c_{transition}$) that are used in computing 620 the optimal path. This weighting is accomplished by varying the adjustable cost scaling factor ($\alpha$) via the user control module 335.

Once the optimal path has been computed 620, the frames corresponding to that path are optionally transformed 625 to match the pitch and/or duration of the musical output frames.

Finally, in either case, whether transformed 625, or not, the frames corresponding to the optimal path are then concatenated to combine the sequence of notes from the music texture database 315 corresponding to the optimal path. The concatenated sequence of notes is then output either as an audio music output sound B' 355, or a new music score $B_{new}$ 360, or both.

The foregoing description of the Concatenative Synthesizer has been presented for the purposes of illustration and description. It is not intended to be exhaustive or to limit the invention to the precise form disclosed. Many modifications and variations are possible in light of the above teaching. Further, it should be noted that any or all of the aforementioned alternate embodiments may be used in any combination desired to form additional hybrid embodiments of the Concatenative Synthesizer. It is intended that the scope of the invention be limited not by this detailed description, but rather by the claims appended hereto.

What is claimed is:

1. A computer-readable medium having computer executable instructions for generating a musical output from a musical input, said computer executable instructions comprising steps for:

receiving a first musical input comprising a first sequence of notes and a first set of characteristics defining those notes;

receiving a database which includes a set of one or more sequences of notes and a second set of characteristics defining those notes, said second set of characteristics including audio samples corresponding to those notes;

identifying a set of potential match candidates from the database for each note of the first sequence of notes;

computing a cost for each potential match candidate by comparing the characteristics defining each potential match candidate with the corresponding characteristics of the first sequence of notes;

computing a transition cost from each match candidate for a given note to each match candidate for the following note;

identifying a globally optimal path through the potential match candidates relative to the sequence of the first sequence of notes by finding a path having a best cost path in terms of the costs for each potential match candidate and the cost of the transitions for that path based on a user adjustable musical texture value;

constructing a musical output by sequentially concatenating the potential match candidates corresponding to the globally optimal path;

wherein the musical texture value enables a user-adjustable balance between per-note accuracy of the musical output relative to the first musical input and stylistic coherence (i.e., correspondence to an artistic style) of the musical output relative to the database by globally weighting the transition cost for each potential match candidate relative to the specified musical texture;

wherein lower musical texture values will result in the musical output closely matching the first musical input, with a correspondingly lower stylistic match to the database; and wherein higher musical texture values will result in the musical output having a higher stylistic match to the database with a correspondingly lower accuracy of match to the first musical input.

2. The computer-readable medium of claim 1 wherein the database is automatically constructed by:

aligning a user selected musical score and a corresponding musical performance;

segmenting the aligned musical score and the corresponding musical performance into a set of notes being delimited by the aligned notes of the musical score.

3. The computer-readable medium of claim 1 wherein the musical output is a computer readable waveform constructed from the audio samples of the database.

4. The computer-readable medium of claim 1 wherein the musical output is a computer readable musical score.

5. The computer-readable medium of claim 1 wherein identifying the globally optimal path further comprises computing a lowest cost note sequence ending in each candidate, then, starting with the last note of the first sequence of notes, computing the globally optimal path.

6. A process for synthesizing a musical score, consisting of process actions for:

receiving a first musical score;

segmenting the musical first musical score to construct a database of corresponding frames;

receiving a second musical score;

segmenting the second musical score into a sequence of frames;

for each frame of the second musical score, identifying a set of candidate frames from the database, said candidate frames representing potential matches to each frame of the second musical score;

computing a match cost for matching each candidate frame to each frame of the second musical score;

computing a transition cost for sequentially transitioning from each potential match to each next potential match for each frame of the second musical score;

identifying an optimal sequential path through the candidate frames in terms of the match costs and transition costs; and constructing a third musical score by sequentially concatenating the candidate frames corresponding to the optimal sequential path.

7. The process of claim 6 wherein one or more of the musical scores are MIDI scores.

8. The process of claim 6 further comprising:

automatically aligning the first musical score and a corresponding musical audio input; and segmenting the musical audio input into samples corresponding to the first musical score to form note-score pairs in the database.

9. The process of claim 8 wherein the musical audio input and the first musical score represents a user selected rendition of a particular song.

10. The process of claim 8 wherein the musical audio input and the first musical score represents user selected renditions of a set of particular songs by a particular artist.

11. The process of claim 8 wherein the musical audio input and the first musical score represents user selected renditions of a set of particular songs corresponding to a particular musical genre.

12. The process of claim 8 wherein the musical audio input and the first musical score represents a user selected rendition of a set of one or more particular songs performed by a particular instrument.

13. The process of claim 8 further comprising constructing a musical audio output corresponding to the third musical score from the note-score pairs of the database.

14. A method for synthesizing a new musical audio output from a first musical audio input and a corresponding first musical score, comprising using a computing device to:

receive a first musical audio input and a corresponding first musical score;

align the first musical audio input and the corresponding first musical score;

construct a database of audio samples from the first musical audio input and the corresponding first musical score by using the alignment of the first musical audio input and the corresponding first musical score to segment the first musical audio input and the corresponding first musical score into a set of frames representing notes of the first musical audio input and the corresponding first musical score;

receive a second musical score;

segment the second musical score into a sequence of frames representing notes of the second musical score;

identify a separate set of candidate frames from the database of audio samples for each frame of the second musical score;

compute a match cost for matching each candidate frame to each frame of the second musical score;

compute a transition cost from each match candidate for a given note of the second musical score to each match candidate for the following note of the second musical score;

identify an optimal path through the candidate frames relative to the computed match and transition costs;

construct a musical audio output by sequentially concatenating the candidate frames corresponding to the optimal sequential path; and construct a third musical score corresponding to the musical audio output wherein the third musical score is a MIDI score.

15. The method of claim 14 wherein the first musical score and the second musical score are MIDI scores.

16. The method of claim 14 wherein the musical audio input and the first musical score represents at least one of:

a user selected rendition of a particular song;

user selected renditions of a set of particular song by a particular artist;

user selected renditions of a set of particular songs corresponding to a particular musical genre; and a user selected rendition of a particular song performed by a particular instrument.

17. The method of claim 14 further comprising providing a single user adjustable global scaling factor, said single adjustable global scaling factor being applied equally to any of each of the match costs and each of the transition costs for weighting any of the match and transition costs for adjusting the optimal path through the candidate frames.

* * * * *